US005535726A

United States Patent [19]

Wilmot et al.

[11] Patent Number: 5,535,726

[45] Date of Patent: Jul. 16, 1996

[54] AUTOMOTIVE IGNITION COIL ASSEMBLY

[75] Inventors: Theodore S. Wilmot, Greenville; Michael J. Huston; Stephen W. Straus, both of Easley, all of S.C.

[73] Assignee: Cooper Industries, Inc., Houston, Tex.

[21] Appl. No.: 435,927

[22] Filed: May 5, 1995

[51] Int. Cl.[6] ..... F02P 3/02

[52] U.S. Cl. ..... 123/635; 123/169 PA; 315/57

[58] Field of Search ..... 123/169 R, 169 PA, 123/635; 315/57

[56] References Cited

U.S. PATENT DOCUMENTS

| | | | |
|---|---|---|---|
| 1,164,113 | 12/1915 | Orswell | 123/169 PA X |
| 2,378,893 | 6/1945 | Berkey et al. | 315/57 |
| 2,459,856 | 1/1949 | Wall | 315/57 |
| 2,461,098 | 2/1949 | Weatherly | 315/57 |
| 2,467,531 | 4/1949 | Lamphere et al. | 315/57 |
| 2,467,534 | 4/1949 | Osterman | 315/57 |
| 2,478,087 | 8/1949 | Bychinsky et al. | 315/57 |
| 2,482,884 | 9/1949 | Tognola et al. | 315/57 |
| 2,571,769 | 10/1951 | Seagall | 315/57 |
| 2,632,132 | 3/1953 | Delano | 315/57 |
| 4,275,334 | 6/1981 | Beeghly | 315/57 |
| 4,277,724 | 7/1981 | Beeghly | 315/57 |
| 4,903,675 | 2/1990 | Huntzinger et al. | 123/635 |

FOREIGN PATENT DOCUMENTS

| | | | |
|---|---|---|---|
| 3859 | 4/1901 | Austria | 123/169 PA |
| 0069889A3 | 6/1982 | European Pat. Off. . | |
| 733114 | 6/1954 | United Kingdom . | |
| 2184484 | 12/1985 | United Kingdom . | |

OTHER PUBLICATIONS

"PATENT ABSTRACTS OF JAPAN", vol. 11, No. 288 (E–542), Sep. 9, 1987, abstract of JP–A–62–089316.

"PATENT ABSTRACTS OF JAPAN", vol. 13, No. 41 (M–791), Jan. 30, 1989, abstract of JP–A–63–248974.

*Primary Examiner*—Tony M. Argenbright

*Attorney, Agent, or Firm*—Burns, Doane Swecker & Mathis

[57] ABSTRACT

A coil and spark plug assembly includes a substantially cylindrical tube housing the coil. The tube includes an element at a first end to transmit a low voltage power source to the coil, and an attachment device at a second end for attaching the tube to an engine. The tube further includes an internal device to house a terminal end of the spark plug and a high voltage connection for connecting the coil to the spark plug. The spark plug includes a firing end, a tower shaped insulator at the terminal end opposite the firing end, and a high voltage terminal recessed within the insulator. The terminal is constructed and arranged to make an electrical connection with the high voltage connector when the terminal end of the spark plug is inserted into the second end of the tube. The spark plug further includes a first surface formed around the spark plug, wherein the surface is constructed and arranged to match a mating surface formed on the engine, and a second surface formed around the spark plug. The second surface is constructed and arranged to match a mating surface formed on the tube. The spark plug can be inserted into the second end of the tube and the tube can thereafter be inserted into an engine.

12 Claims, 2 Drawing Sheets

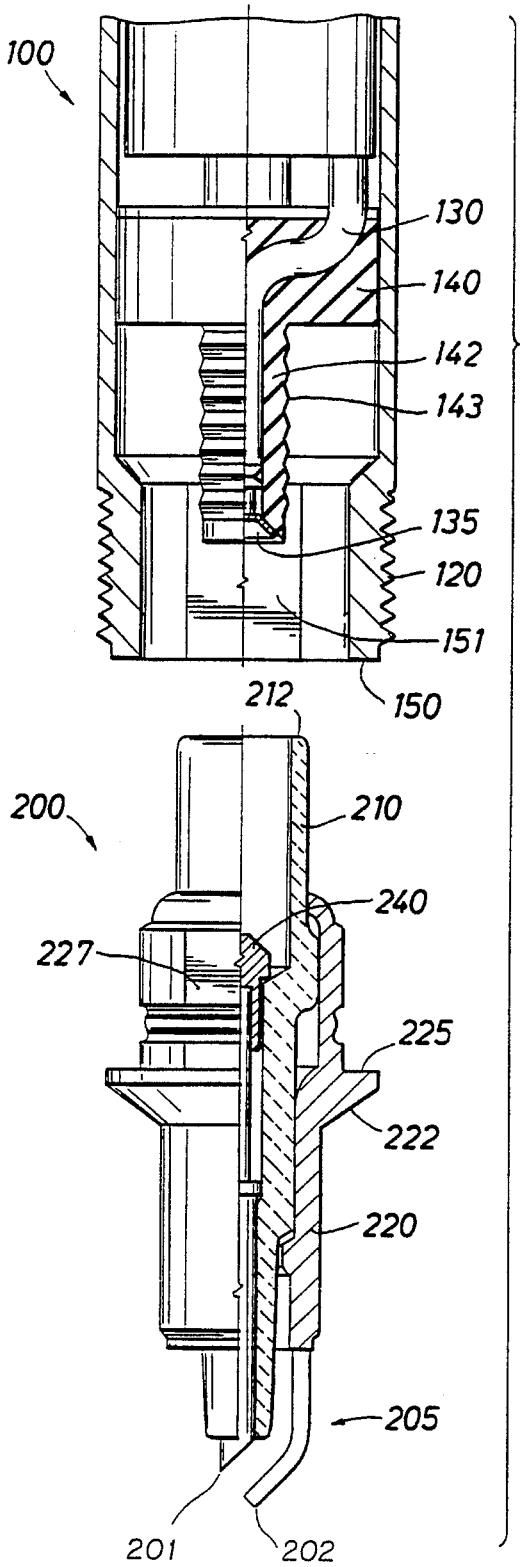
FIG. 1
FIG. 4
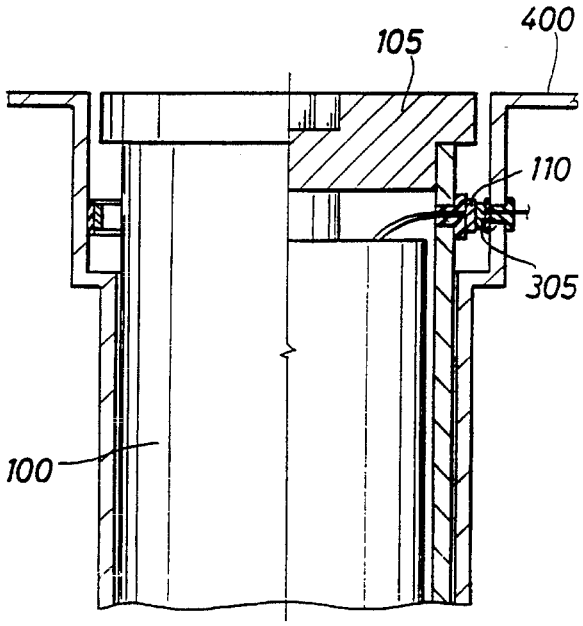

AUTOMOTIVE IGNITION COIL ASSEMBLY

BACKGROUND OF THE INVENTION

The present invention relates to an ignition coil and spark plug combination; more specifically, the present invention relates to a coil and plug combination that can be installed in an automobile engine as a one-piece unit, yet allows easy access to and replacement of the spark plug.

The major advantage of prior art coil and plug combinations are well known and include the elimination of high tension spark plug wires, reduction of current leakage and reduction of electronic interference. In most prior art designs however, the coil assembly is a separate assembly that fits over the plug and must first be removed in order to access the spark plug. Removing the coil means disengaging the sensitive sealing mechanisms between the coil and plug which are necessarily intricate in order to protect the coil from heat and contaminants generated by the operation of the plug. Reinstallation of these assemblies requires threading the plug into the engine and then reinstallation of the coil over the plug in a separate step. In those designs wherein the plug and coil are permanently connected together, changing the plug requires changing the entire assembly including the coil, an expensive proposition.

There is a need therefore, for a plug and coil combination that can be installed into the engine in one step.

There is a further need therefore, for a plug and coil combination that allows the plug to be quickly accessed and replaced repeatedly without damaging the sealing means between the coil and plug.

SUMMARY OF THE INVENTION

A coil is enclosed in a cylindrical tube that also houses an upper end of a spark plug, exposing the firing end of the plug. The tube has means at a first end for connection to a low voltage source and the lower portion of the tube includes threads which allow the tube instead of the plug to be installed directly into the engine, exposing the firing end of the plug to the combustion chamber of the engine. There is a compression seal and a self centering, high voltage connection between the coil and the plug.

In operation, the plug is first inserted into the tube where it is held by a frictional relationship between the insulator of the plug and the compression seal in the tube. As the tube is threaded into the engine, the plug is urged into the tube, energizing the seal around the high voltage connection and causing various surfaces of the engine and the plug and the plug and tube to mate.

In the preferred embodiment, the low voltage connection to the tube is accomplished by a conductive ring in the valve cover of the engine where the top of the installed tube is located. The top of the tube includes a conductive tab which contacts the ring and completes the low voltage connection regardless of the rotational position of the tube with resect to the engine.

The high voltage connection between the coil and the plug is accomplished with a resiliently mounted, cup-shaped terminal in the tube that mates with a cone-shaped terminal in the plug. As the tube is threaded into the engine and the plug is urged towards the coil, the cone-shaped terminal is forced into the cup-shaped terminal where it is held in positive contact.

BRIEF DESCRIPTION OF THE DRAWINGS

FIG. 1 is a view of the coil and spark plug assembly;

FIG. 4 is a view of the tube within a valve cover.

DESCRIPTION OF A PREFERRED EMBODIMENT

Figure 3:
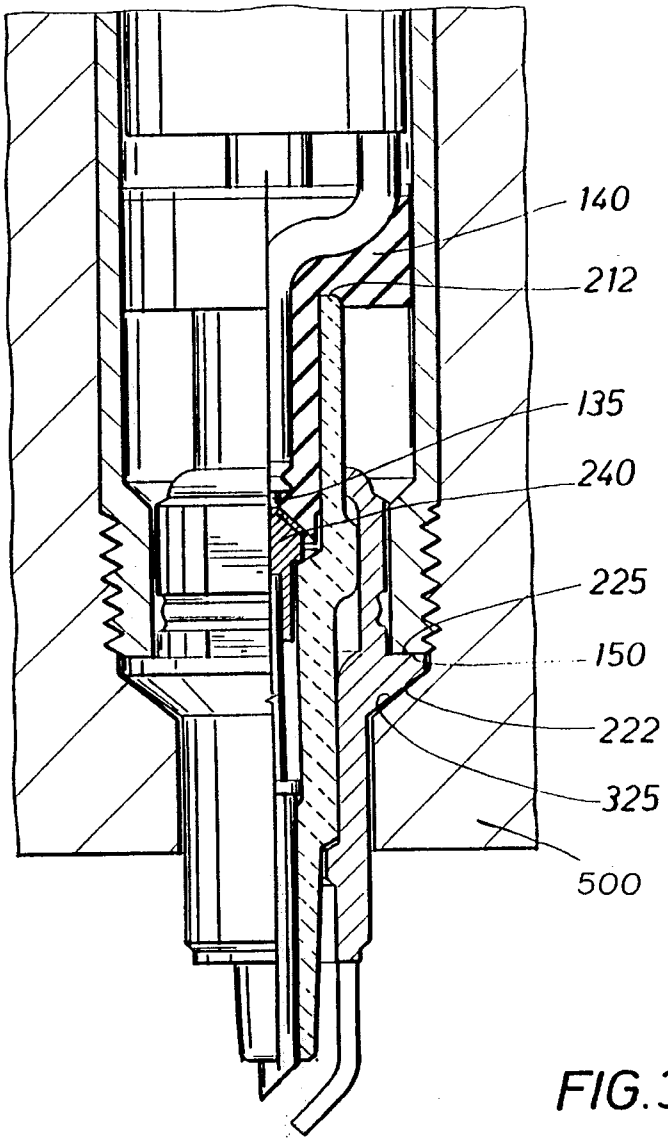
FIG. 3 is a view of the cylindrical tube tightened against the spark plug.

FIG. 1 is an exploded view showing the various parts of the present invention including tube 100 and plug 200. The plug utilized in the invention includes a firing end 205, an insulator 210, and a shell 220. In the preferred embodiment, the firing end of the center electrode 201 is formed at an angle to increase the surface firing area between the center 201 and the outer 202 electrodes. Shell 220 includes tapered shoulder 222 which seats in the automobile engine (see FIGS. 2 & 3) and flat shoulder 225 which provides a seat for the bottom surface 150 of tube 100 (see FIG. 2). Unlike most spark plugs, the spark plug shell 220 of the present invention preferably has no threads. Located above flat shoulder 225 are flats, one of which 227 is visible in FIG. 1. The flats provide means to prevent rotation between plug 200 to tube 100. Terminal 240 is enclosed by the upper portion of insulator 210. Insulator 210 is tower-shaped with terminal 240 recessed within. In the preferred embodiment, terminal 240 is cone-shaped to more easily accept the terminal of the coil 100. However, the invention is not limited to use with terminals of any particular geometric shape.

Tube 100 can be made of any material, conductive or non-conductive and serves to house the ignition coil and the high tension connection between the coil and the plug. As shown in FIG. 4, the tube 100 is designed to fit within a valve cover 400 and includes cap 105. In order to transmit a low voltage source of power to the coil, a conductive tab 110 located on the outer surface of the tube 100 is electrically connected to the coil (not shown) in the interior of the tube. When the assembly is installed, conductive tab 110 is electrically energized through a conductive ring 305 located in the valve cover 400 of the engine. In this manner, a low voltage source of power is available to tab 110 via the conductive ring 305 regardless of the rotational position of the tube 100 within the valve cover 400.

The assembly is designed with several points of contact to ensure a proper fit in operation. As shown in FIG. 1, the lower portion of tube 100 includes threads 120 which allow insertion of the tube 100 into a threaded orifice of the engine 300 of the automobile (see FIG. 3). The bottom surface 150 of tube 100 seats on flat shoulder 225 of spark plug 200. In the interior of the lower portion of tube 100 are inwardly facing flats, one of which 151 (FIG. 1) is visible. The flats mate with the flats of plug 200 when the plug is inserted into tube 100.

The interior of the upper portion of tube 100 contains the coil (not shown) and includes a primary and secondary winding. Automotive step-up coils of this type are well known to those skilled in the art and will not be discussed herein. The lower portion of the interior of tube 100 includes wire 130 which supplies a high voltage from the coil to cup-shaped terminal 135. Terminal 135 is constructed and arranged to mate with cone-shaped terminal 240 of plug 200. Wire 130 extends through elastomeric wall 140 and elastomeric neck 142. The wall 140 and neck 142 seal the area between the upper and lower portions of tube 100 thus protecting the sensitive coil from heat and contaminants. The wall 140 also serves to seal the circular end 212 of insulator 210 as the plug is inserted into the tube (see FIG. 3). Neck 142 is designed to fit within the upper insulator 210 in frictional relationship holding the plug 200 in the tube 100 before installation of the tube 100 into the engine 300.

In the preferred embodiment, neck 142 includes ridges 143 along its outer surface in order to increase the dielectric distance from the cup-shaped terminal 135 to the electrical ground. High voltage wire 130, because it extends through wall 140 and neck 142, has elastic properties and allows cup-shaped terminal 135 to adjust itself as it mates with cone-shaped terminal 240 as the plug 200 is inserted into the tube 100.

Figure 2:
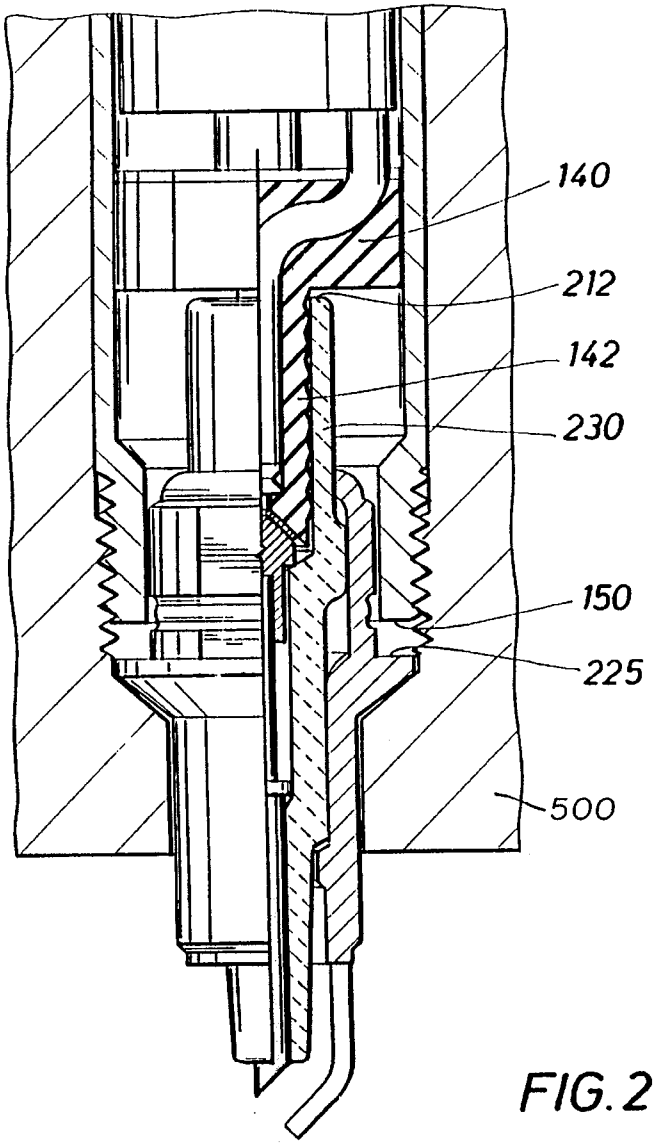
FIG. 2 is a partial view of the spark plug assembled within the cylindrical tube before the tube is tightened against the spark plug.

To install the assembly, the plug 200 is first installed into tube 100 with the flats of the tube 151, 152 (one shown) aligned with the flats of the plug 227, 228 (one shown). The assembly is then dropped through the valve cover to the engine as shown in FIG. 2. Prior to being threaded into the engine, the circular end 212 of insulator 210 is in contact with the elastomeric wall 140 and the bottom surface 150 of tube 100 is just above flat surface 225 of plug 200. Additionally, elastomeric neck 142 has been inserted into upper portion 230 of insulator 210 and the plug is retained in the tube 100 by the frictional relationship between the neck 142 and the interior of the insulator 210.

The tube 100 and plug 200 assembly is then threaded into the engine (500) as shown in FIG. 3. As the threading is completed, tapered shoulder 222 of plug 200 contacts seat 325 of the engine. Bottom surface 150 of tube 100 contacts flat shoulder 225 of plug 200. Additionally, circular end 212 of insulator 210 is sealingly pressed against the elastomeric wall 140. Also, cone-shaped contact 240 mates with cup-shaped contact 135. Finally, as shown in FIG. 4, conductive tab 110 of tube 100 has electrically contacted conductive ring 305 of valve cover 400.

The present invention, because it provides a coil and plug assembly which can be installed in an engine as a unit, solves the problem associated with coil and plug combinations that require the coil to first be removed before the plug can be removed. Additionally, because of the length of the tube 100, the invention is well suited for use with engines having the spark plugs located between the valves and requiring the plugs to be accessed through an opening in the valve cover. A typical engine of this type is the 4-valve per cylinder, overhead cam engine. However, the invention is not limited to use with any certain type of engine.

It will be understood by those of the art that the present invention has been described by its preferred embodiment and the spirit of the invention includes various other embodiments as well. For example, the conductive ring 305 and conductive tab 110 combination at the top of tube 100 could be reversed whereby the ring is located in at the top of the tube and the tab is located at the valve cover 400. Additionally, successive conductive rings and tabs could be utilized to send information concerning a cylinder's performance to a processing station where the operation of the coil could be adjusted to correct engine or ignition irregularities.

We claim:

1. A coil and spark plug assembly comprising:

a substantially cylindrical tube housing said coil, said tube including:

means at a first end to transmit a low voltage power source to said coil;

attachment means, at a second end for attachment to an engine;

internal means to house a terminal end of said spark plug; and high voltage connection means for connecting said coil to the spark plug;

said spark plug having:

a firing end;

a tower-shaped insulator at said terminal end opposite said firing end;

a high voltage terminal recessed within said insulator, said terminal constructed and arranged to make an electrical connection with said high voltage connection means when said terminal end of said plug is inserted into said second end of said tube;

a first surface formed around said plug, said first surface constructed and arranged to match a mating surface formed on said engine; and a second surface formed around said plug, said second surface constructed and arranged to match a mating surface formed on said tube;

whereby said plug can be inserted into said second end of said tube and, thereafter, said tube can be inserted into said engine.

2. The coil and spark plug assembly in claim 1, whereby said attachment means at said second end includes threads formed at the outside of said second end of said tube and mating threads formed on said engine allowing said second end of said tube to be held in said engine.

3. The coil and spark plug assembly in claim 2, whereby said high voltage connection means to said spark plug terminal includes a high voltage wire and terminal, said wire encased in a resilient material whereby said wire and terminal are flexible.

4. The coil and spark plug assembly in claim 3, whereby when the terminal end of said plug is inserted into the second end of said tube, said high voltage wire and terminal extend into said tower shaped insulator of said plug contacting said plug terminal.

5. The coil and spark plug assembly in claim 4, whereby: said plug is held within said tube by a frictional relationship between said tower-shaped insulator and said high voltage wire and terminal.

6. The coil and spark plug assembly in claim 5, whereby as said tube and plug are threaded into said engine, said first surface formed around said plug seats within a mating surface formed on said engine and said second surface formed around said plug contacts said second end of said tube and said firing end of said plug is held within said engine.

7. The coil and spark plug assembly in claim 6, whereby as said tube and plug are threaded into said engine, said high voltage terminal is urged into said high voltage connection means creating a mechanical and electrical connection between said high voltage terminal and said high voltage connection means.

8. The coil and spark plug assembly in claim 7, whereby as said tube and plug are threaded into said engine, said tower-shaped insulator contacts and deforms a thermoplastic material in an area around a perimeter of said tower-shaped insulator to form a seal.

9. The coil and spark plug assembly in claim 8, whereby said high voltage connection means is cup-shaped and said high voltage terminal is cone-shaped allowing a secure, self-centering connection between said high voltage terminal and said high voltage connection means when said tube and plug are threaded into said engine.

10. The coil and spark plug assembly in claim 9, whereby said means at the first end of said tube to transmit the low voltage power source to said coil includes a conductive point on the outside of said tube electrically connected to a low voltage wire on the inside of said tube extending to said coil.

11. The coil and spark plug assembly in claim 10, whereby said means at the first end of said tube to transmit the low voltage power source to said coil further includes a conductive ring located in a valve cover surrounding said first end of said tube, said ring having a source of low voltage power and constructed and arranged to contact said conductive point on said tube thereby transmitting said low voltage power source to said coil.

12. The coil and spark plug assembly in claim 11, whereby when said tube and plug are threaded into said engine, said conductive ring in said valve cover is in contact with said conductive point at said first end of said tube.

* * * * *